US005788528A

United States Patent [19]

Orr, Jr. et al.

[11] Patent Number: 5,788,528

[45] Date of Patent: Aug. 4, 1998

[54] CABLE CONNECTOR WITH A RELEASABLE CLIP

[75] Inventors: Lawrence William Orr, Jr., Simpsonville, S.C.; Roland A. Kern; Richard John Kern, both of Lake Forest, Calif.

[73] Assignee: Woven Electronics Corporation, Simpsonville, S.C.

[21] Appl. No.: 681,787

[22] Filed: Jul. 29, 1996

[51] Int. Cl.[6] ..... H01R 13/627

[52] U.S. Cl. ..... 439/358; 439/96; 439/473; 439/902

[58] Field of Search ..... 439/350–358, 439/610, 462, 466, 468, 469, 473, 902, 96

[56] References Cited

U.S. PATENT DOCUMENTS

| | | | |
|---|---|---|---|
| 3,165,574 | 1/1965 | Carling | 174/59 |
| 3,209,306 | 9/1965 | Grieshaber et al. | 439/473 |
| 3,737,833 | 6/1973 | Jerominek | 339/17 F |
| 3,977,756 | 8/1976 | Rodondi | 339/176 |
| 4,120,553 | 10/1978 | Muz | 439/352 |
| 4,211,466 | 7/1980 | Reynolds | 339/176 |
| 4,511,196 | 4/1985 | Schuler et al. | 439/96 |
| 4,585,292 | 4/1986 | Frantz et al. | 339/143 R |
| 4,641,902 | 2/1987 | Fusselman | 439/350 |
| 4,699,438 | 10/1987 | Kikuta | 439/353 |
| 4,712,298 | 12/1987 | Mondor, III | 29/861 |
| 4,721,483 | 1/1988 | Dickie | 439/610 |
| 4,726,783 | 2/1988 | Nakazawa et al. | 439/350 |
| 4,842,547 | 6/1989 | Defibaugh et al. | 439/466 |
| 5,154,629 | 10/1992 | Carver et al. | 439/352 |
| 5,383,796 | 1/1995 | Bowen et al. | 439/469 |
| 5,449,298 | 9/1995 | Fetterolf, Sr. et al. | 439/350 |
| 5,545,052 | 8/1996 | Hirai | 439/354 |

FOREIGN PATENT DOCUMENTS

| | | | |
|---|---|---|---|
| 2-299178 | 12/1990 | Japan | H01R 13/52 |
| 0484595 | 9/1975 | Russian Federation | 439/358 |
| 0547880 | 2/1977 | Russian Federation | 439/358 |
| 2042827 | 9/1980 | United Kingdom | 439/350 |

*Primary Examiner*—Neil Abrams
*Assistant Examiner*—Katrina Davis
*Attorney, Agent, or Firm*—Cort Flint; Robert R. Reed

[57] ABSTRACT

The high-speed electrical transmission cable connector assembly of this invention includes an electrical connector having a connector backshell with an internal cavity for receiving an electrical insert to interface with an electrical interface device. An adequate amount of space is provided by the internal cavity within the backshell for routing wires of the transmission cable through a neck in an entrance side of the backshell to terminate within the insert. The backshell has a truncated side and a short lateral side for saving space and weight of the electrical connector. A grounding terminal is carried within the internal cavity of the backshell adjacent to the neck on a short neck side for grounding wires within a short distance inside the backshell. An attachment and release mechanism is provided for connecting and disconnecting the interface device to the electrical insert within the backshell. A pair of attachment clips are provided inside a clip channel on two sides of the backshell for attaching and releasing the interface device to the electrical connector.

8 Claims, 5 Drawing Sheets

CABLE CONNECTOR WITH A RELEASABLE CLIP

BACKGROUND OF THE INVENTION

This invention relates to an electrical connector for terminating of a high-speed electrical transmission cable to be connected with an associated electrical interface device for military electrical transmission systems and other applications. In particular, a space saving electrical connector is designed with an enhanced mechanism for holding and manually releasing the interface device in its attached relationship with the electrical connector. Connector space is also saved by grounding of shielded wires of the cable within a short distance inside the electrical connector.

In many applications of electrical connectors for terminating an electrical cable, the wires are required to be terminated in the connector so that an associated electrical interface device can be attached to the connector and released from the connector by hand. The necessity to have a connecting mechanism to quickly connect two connector components together and hold them strongly attached to one another is essential. However, it has become essential for present day military systems and the like that the mechanism must be capable of being quickly released by hand on demand. The mechanism must be designed to allow a technician to grip the mechanism to achieve a quick and easy release of the two components from one another.

The space required for an electrical connector being attached to an associated electrical interface device is made larger by the necessity to terminate a large number of wires parallel to an interface axis which may be at an angle to the direction of the electrical cable entering an entrance side of the connector. In particular, the electrical connector must include an electrical insert with a large number of electrical terminals that must be aligned with the interface axis so that the interface device can be plugged into the connector and held in a connected but releasable relationship. Additional connector space is further required as some of the wires of the electrical cable may also include grounding or shielding components which must be electrically connected to the electrical connector. Space and weight reductions continue to be a high priority with military systems and the like.

A number of connectors are known in the industry for providing termination of wires in one electrical component and continuation of wires in an associated component where the two components are releasably connected by some sort of connecting or hooking mechanism or device. Typical components of these devices include screws, springs, hooks, prongs, latch arms, fingers, slots, flanges, pawls, resilient protrusions and the like. Each of these devices are disclosed in at least one of U.S. Pat. Nos. 3,165,574; 3,737,833; 3,977,756; 4,211,466; and 4,712,298 and Japanese Patent No. 2-299178. However, these references do not satisfy the need to provide means for a quick attachment, strong holding capabilities and releasable by hand with little effort.

The use of metal clips for mechanically connecting an electrical connector to an associated electrical interface device is also known in the industry. Clips are is used in the plugs and receptacles for connecting peripheral devices to computer components. Typically these clips provide short prongs for connecting the electrical connector to the interface device and the rotational motion of the clip when activated by hand is very limited. The holding and releasing capability of these clips do not provide the essential features for connecting high speed electrical transmission cables used for military systems and the like. The prongs of the clip do not have a wide contact area to provide a large holding force and limited space around the clips impede the movement of the clips and reduce its ability to quickly release the connector from the interface device by hand. Military systems are also subjected to environmental conditions where debris and the like may further impede the operation of any attachment mechanism not having adequate space within which to function.

The special requirement of grounding only selected wires from a bundle of wires in a cable to an electrical connector is also an essential requirement for many military systems and the like. Grounding may be the result of shielded smaller cables, such a coaxial cable, which are included in a bundle of wires making up the total cable. The need exists to only ground those wires which require grounding. Typical grounding of a totally shielded cables are disclosed in U.S. Pat. Nos. 4,585,292 and 4,721,483. These shielded cable connections do not provide for grounding of individual wires of a bundle of wires within the electrical cable.

Accordingly, an object of the present invention is to provide an electrical connector having a shape and size to conserve the space required for routing and terminating wires of a high-speed electrical transmission cable to an electrical insert for interfacing with an associated interface device.

Another object of the present invention is to provide an enhanced attachment and release mechanism for the interface connection between an electrical connector an associated electrical interface device.

A further object of the present invention is to provide for electrically grounding individual wires in a bundle of wires to an electrical connector having an electrical insert for termination of all wires in the bundle.

Yet another object of the present invention is to provide for termination of the wires of an electrical cable in an electrical insert for connection to an interface device along an interface axis at an angle to a cable axis of the electrical cable.

SUMMARY OF THE INVENTION

The above objectives are accomplished according to the present invention by providing an electrical connector having a connector backshell with an internal cavity for receiving an electrical insert to interface with an electrical interface device. The internal cavity within the backshell is to have only adequate space for routing wires of a high-speed electrical transmission cable entering a neck of the backshell to terminate within the insert. The backshell can have a square shape but is preferably made to have a truncated side at a side angle realized by a shortened lateral side for saving space and weight of the electrical connector. A grounding terminal is carried within the internal cavity of the backshell adjacent to a neck for grounding wires within a short distance inside the backshell. An improved attachment and release mechanism is provided for connecting and disconnecting the interface device to the electrical insert within the backshell. The mechanism includes an attachment clip located inside a clip channel on two sides of the backshell for attaching and manually releasing the interface device to and from the electrical connector.

In one embodiment of the invention a releasable cable connector assembly is provided for terminating wires of an electrical cable within an electrical insert for mating with an associated electrical interface device parallel to an interface axis to conserve weight and space. The connector assembly comprises a connector backshell having an interior cavity being accessible for receiving the wires and the electrical insert within the backshell. An open backshell face normal to the interface axis is for accessing the electrical insert to provide a mating interface between the interface device and the insert. A truncated side of the backshell generally opposite the open backshell face is included for reducing the weight of the backshell and maintaining adequate space within the interior cavity for terminating the wires. An entrance side of the backshell extends generally perpendicular to the open backshell face along one side of the connector backshell and has a entrance neck for receiving the cable to route wires of the cable to the interior cavity along a cable axis at an angle to the interface axis. A short neck side of the backshell starts from the entrance neck on the entrance side and extends parallel to the cable axis to interface with the truncated side at a side angle. A lateral side of the backshell also extends generally perpendicular to the open backshell face and is positioned opposite said entrance side of the connector backshell. A grounding terminal, carried within the interior cavity of the connector backshell, is located at the intersection of the neck side and the truncated side for grounding a shielded portion of at least one of the wires to the backshell in a relatively short distance from the neck. A connector mechanism, including at least one attachment clip, is included for engaging and holding the associated interface device in an attached relationship with the electrical insert at the open backshell face. The mechanism is further included for manually releasing the interface device from the attached relationship to quickly disconnect the interface device from the electrical connector.

In another embodiment of the present invention an improved interface attachment and release mechanism is used in an electrical connector which connects wires of a high-speed electrical transmission cable to an associated electrical interface device having an interface attachment. The electrical connector includes a connector backshell for receiving the wires for termination to an electrical insert carried by the connector. The improved mechanism comprises a pair of pivotal attachment clips carried by the connector backshell to provide an enhanced pivotal movement of the clip about a pivot axis associated with the backshell. Pivot pins are each carried by the connector backshell along a respective pivot axis to extend through a respective attachment clip for accommodating the pivotal movement. Attachment stems of the clips extend from a respective pivot pin and terminating at terminal ends. The mechanism further comprises an solid attachment flange carried at the terminal ends of the attachment stems for engaging the interface attachment to provide a reliable attachment relationship. Clip springs of the clips are in contact with a wall of the connector backshell to hold the attachment stem in a first pivotal position, wherein the electrical connector is maintained in an positive attachment relationship with the interface attachment. The improved mechanism further includes clip release arms for manual operation to pivot each attachment stem about a pivot axis to a second pivotal position for disengaging the attachment flange from the interface attachment prior to disconnecting the connector from the positive attachment relationship with the interface device.

In a further embodiment of the invention a method for terminating an electrical transmission cable with a generally circular cross-section for providing a releasable attachment to an electrical interface device to conserve connecting space is disclosed and claimed. The method includes the following steps. A first step includes providing a connector backshell having an open backshell face normal to an interface axis, a truncated side opposite to the open backshell face, a cable entrance neck on an entrance side for receiving the cable along a cable axis and an internal cavity for routing wires of the cable inside the backshell. A second step includes providing a connector insert to be received in the backshell having a plurality of electrical terminals for terminating wires of the cable. In a third step the method includes exposing the wires at a terminal end of the cable and placing the exposed wires through the cable entrance neck of the backshell to extend within the internal cavity. A fourth step includes accessing the internal cavity of the backshell for routing the wires and placing the connector insert within the internal cavity. In a fifth step the method includes terminating the wires of the cable within the connector insert so that terminal ends of the wires can be aligned with the interface axis and terminated in electrical terminals of the insert within a minimum amount of cavity space. A sixth step comprises terminating a shielded portion of at least one wire to a grounding terminal carried within the internal cavity. The terminal is located adjacent to the neck at the intersection of a neck side and the truncated side for grounding the at least one wire to the backshell. A seventh step includes closing the backshell to contain the wires within the internal cavity for providing protection for the wires being terminated and grounded within the connector backshell. In an eighth step the method comprises affixing a cable retainer to the neck of the backshell for holding the cable attached to the backshell and providing strain relief for the cable. In a final step the method includes providing an attachment and release mechanism associated with a clip channel of the backshell for connecting the interface device to the electrical connector along the interface axis. The mechanism has a first pivotal position for providing the attachment and a second pivotal position for releasing the interface device from the electrical insert.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail. An electrical connector is provided for terminating wires of a high-speed electrical transmission cable to an electrical insert in a minimum amount of space for connecting the insert to an associated electrical interface device. The connector and interface device are used for transmitting electrical signals across a connector interface for military systems and the like. Connection occurs along an interface axis which may be at an angle to the cable axis of the transmission cable. The interface device is removably attached to the electrical connector by an enhanced mechanism carried by the connector. Some of the wires in the cable have components which must also be grounded to the electrical connector.

Figure 1:
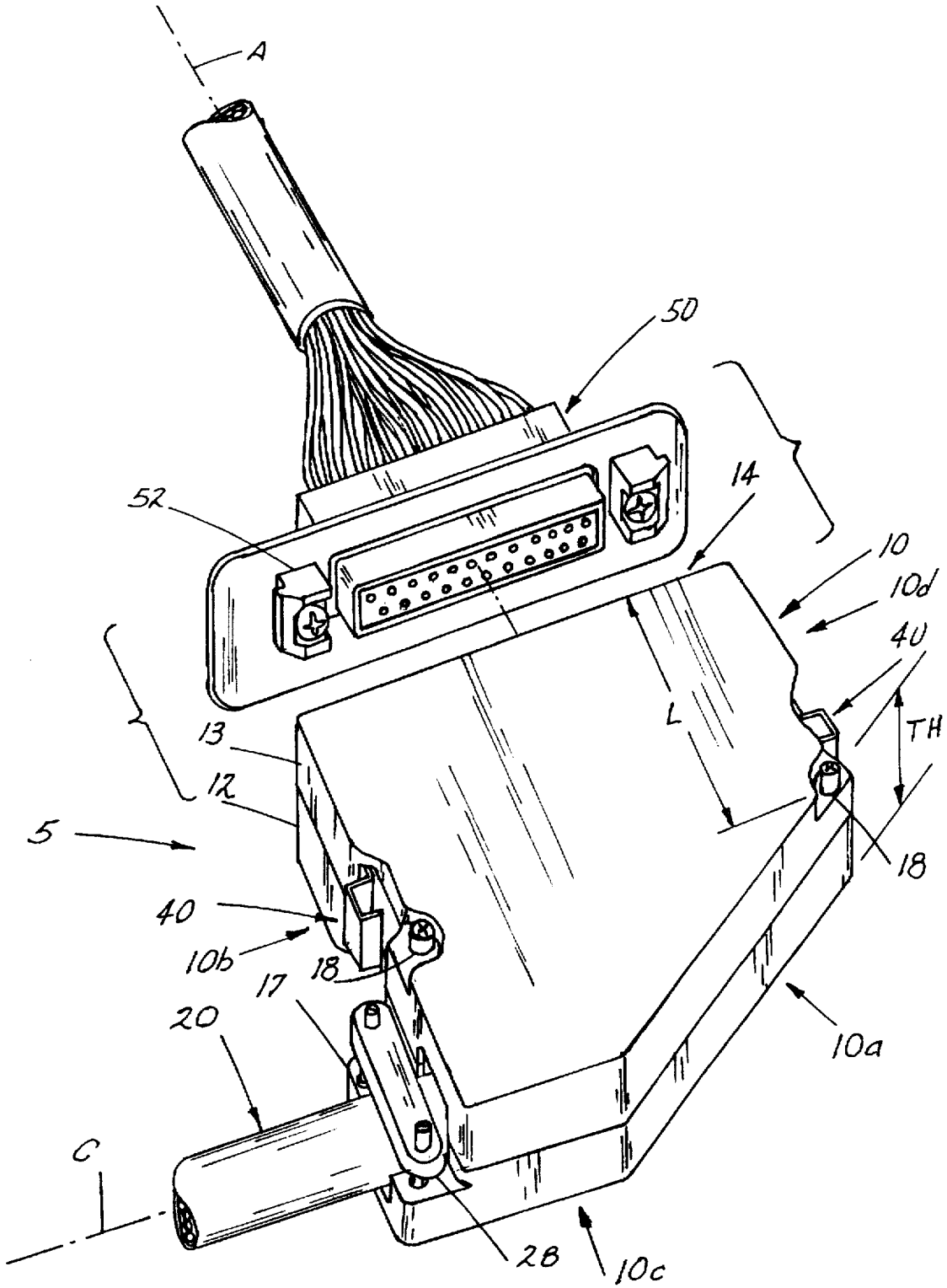
FIG. 1 is a perspective view of the electrical connector of this invention in a position to receive an associated electrical interface device.

An electrical connector of this invention is illustrated in FIG. 1. A connector backshell 10 includes a first shell portion 12 and a second shell portion 13 connected by a pair of fasteners 18. A neck 17 extends form the first shell portion on an entrance side 10*b* to receive a high speed electrical transmission cable 20 having a plurality of wires to be terminated within the connector backshell. A retainer clamp 28 holds the cable attached to the backshell. The two part connector backshell provides an open backshell face 14 for receiving an associated electrical interface device 50. The interface device has interface attachments 52 for attachment to the electrical connector for effecting the high-speed transmission of electrical signals through the electrical connector and interface device. The electrical connector includes attachment clips 40 that extend from a clip channel within the backshell to connect to the interface attachment 52 at the open backshell face 14. The attachment clips are manually displaced to release the interface device from an attached relationship with the electrical connector.

The backshell has four side portions in addition to the open backshell face 14. The general shape and size of the connector backshell is for saving space and weight for the electrical connector. A truncated side 10*a* of the backshell is made possible by proper routing and grounding of wires within the backshell. The entrance side 10*b* extends perpendicular to the open backshell face 14 and includes the neck 17 to receive the cable 20. A short neck side 10*c* extends from the neck to join with the truncated side 10*a*. A lateral side 10*d* also extends perpendicular to the open backshell face opposite to the entrance side 10*b*. The lateral side has a smaller dimension than the entrance side being a length L with a value only large enough for routing wires inside the backshell and providing space for the attachment clip 40. For example, the length L of the lateral side is approximately 1.25 inches and the length of a entrance side is approximately 2.21 inches for a typical preferred connector of this invention. The thickness of the backshell TH is maintained to be only large enough to accommodate the interface device 50 and provide a low-profile electrical connector. The backshell can be made of a metalized plastic or a cast aluminum, but is preferably made of a 6061-T6 aluminum alloy material with an electroless nickel finish.

Figure 2:
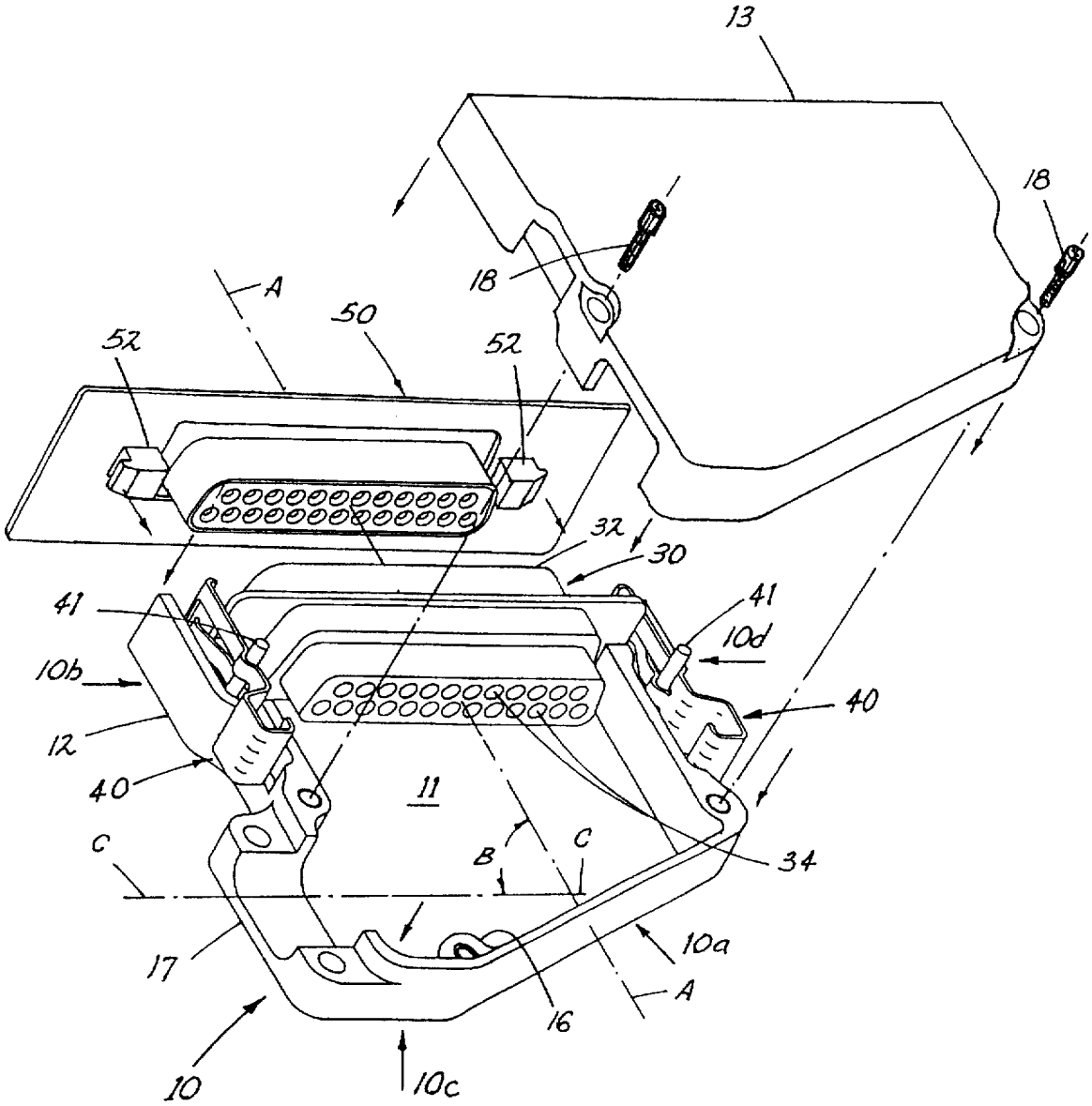
FIG. 2 is an exploded perspective view illustrating first and second shell portions of a connector backshell of the preferred embodiment of this invention having an electrical insert within the backshell and illustrating the interface device in a position to be attached to the insert.

The configuration and operation of the electrical connector are realized by referring to the illustration of FIG. 2. The second shell portion 13 has been displaced from the first shell portion 12 for providing access to the interior cavity 11 of the connector backshell 10. The electrical insert 30 has been positioned for receiving wires within the electrical terminals 34 of the insert. An interface device 50 is in a position to be connected to the insert along the interface axis A—A. Attachment clips 40 are placed over pivot pins 41 carried by the backshell to be in a position for connecting with interface attachments 52 of the interface device. The attachment clips pivot about the pivot pins to connect with the interface attachment and hold the interface device in a connected relationship with the insert 30.

The connector neck 17 is positioned on the entrance side 10*b* of the backshell for receiving a cable along a cable axis C—C. The cable axis is at an angle B with respect to the interface axis. The wires are to be routed and terminated in a direction rotated from the direction they are received within the interior cavity 11. Routing of wires to the electrical terminals 34 allows the lateral side 10*d* of the backshell to have a smaller length so that a truncated side 10*a* can be formed with the backshell. A grounding terminal 16 is located near the neck at the intersection of the neck side 10*c* with the truncated side 10*a*.

Figure 3:
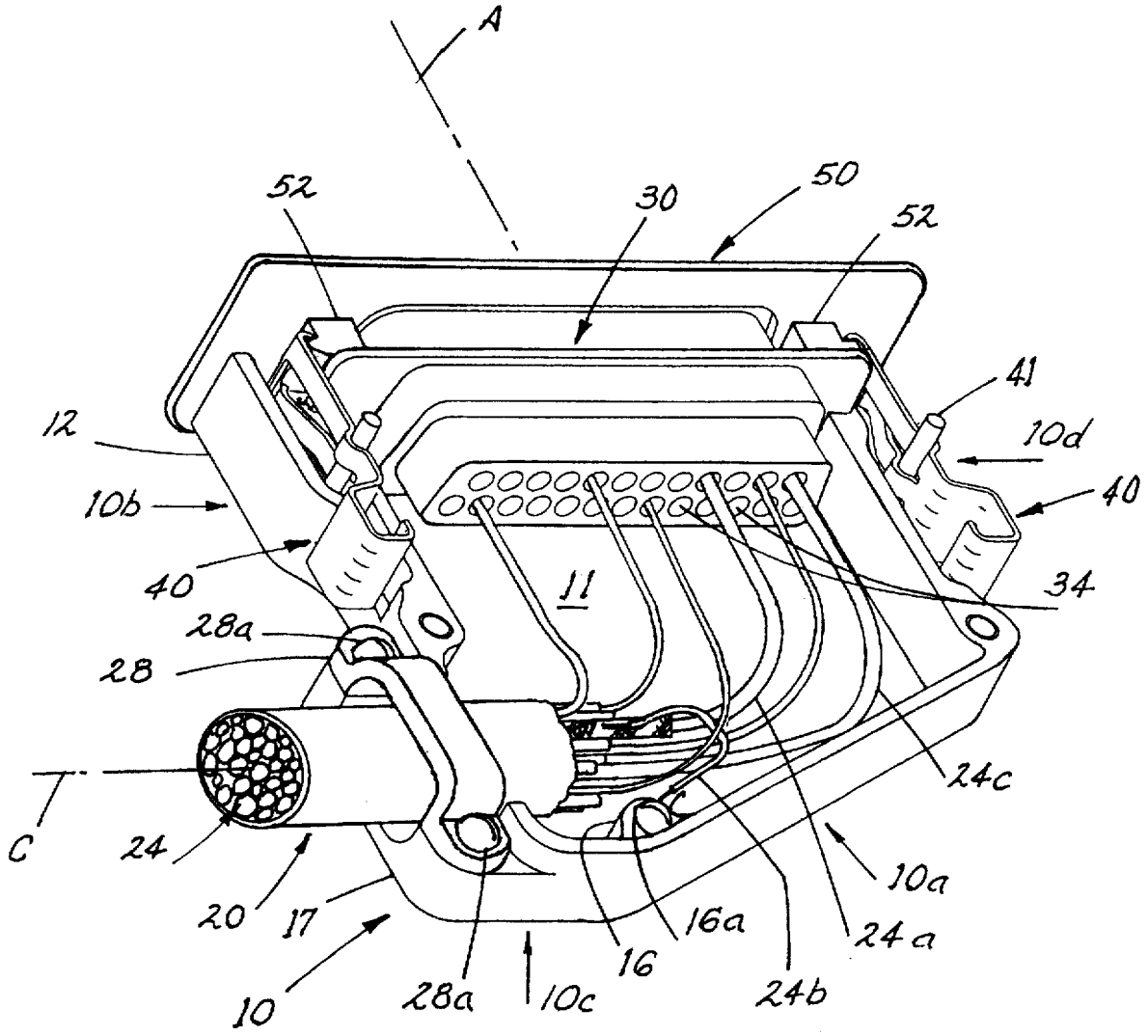
FIG. 3 is a perspective view of the connector of this invention with a second shell portion removed from a first shell portion to show wires of an electrical cable entering the connector through a neck along a cable axis and being terminated in the insert and the insert being connected to the interface device parallel to an interface axis.

The electrical cable contains a bundle of wires which are to be terminated within electrical terminals 34 of the electrical insert 30, as illustrated in FIG. 3. The second shell portion has been removed in this illustration to show the space available to access the wires 24 and the electrical insert 30. The wires 24 of the cable 20 are exposed as they enter the connector neck 17 of the connector backshell 10. A cable retainer rib 28 has retainer fasteners 28*a* for holding the cable attached to the neck of the backshell to provide a strain relief attachment to said backshell. Only a limited number of wires are shown to be terminated within electrical terminals 34 of the electrical insert 30, for clarity in the illustration. A large bundle of wires may be included in the cable to correspond with the number of electrical terminals contained in the insert. The cable enters neck 17 along the cable axis C and the wires are terminated in the electrical terminals 34 parallel to the interface axis A at an angle to the cable axis.

A number of wires within the electrical cable may be ground wires or have shielded portions of the wire which must be grounded to the connector backshell 10. This is illustrated in FIG. 3 by a shielded wire 24*a* shown to have an outer metallic shield component. A ground wire 24*b* is affixed to the outer shield and extends to a grounding terminal 16 of the backshell. A ground terminal fastener 16*a* attaches the ground wire to the grounding terminal. The grounding terminal 16 is positioned adjacent to the neck 17 to be in a location to limit the extent that the shielded component of wire 24*a* must extend into the internal cavity 11. The grounding terminal has an optimum location at the intersection of the short neck side 10*c* and the truncated side 10*a*. This location of the grounding terminal is unique to this connector assembly of this invention to save space for routing wires within the internal cavity 11 and to conserve the overall weight of the electrical connector.

A further savings in space and weight of the electric connector of this invention is provided by eliminating the unnecessary volume within the internal cavity for routing the wires. The lateral side 10*d* is preferably reduced in length to provide only enough room for the attachment clip 40. These two features result in providing a truncated side 10*a* of the backshell 10 which extends at a side angle D with respect to a neck side 10*c* adjacent the neck 17 to connect with a lateral side 10*d* having a preferred length L smaller than the length of the entrance side 10*b* (see FIGS. 1 and 5). The side angle can have a value in the range of zero degrees to about 40 degrees. The preferred side angle D is about 30 degrees. The neck side, the truncated side and the lateral side continue to provide adequate space for the routing of wires within the internal cavity. For example, wire 24*c* has adequate space to turn and terminate within an electrical terminal in the insert.

Figure 4A:
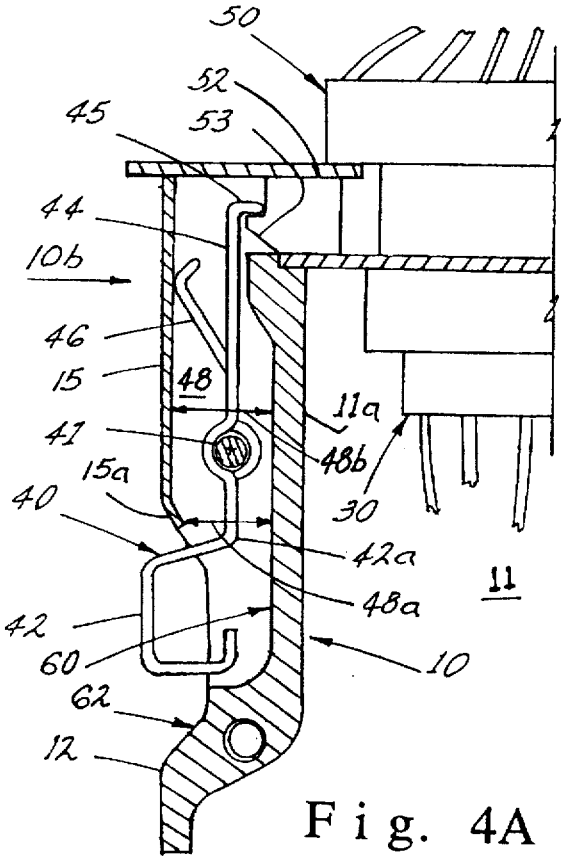
FIG. 4A is partial cross-sectional view of the electrical connector of this invention showing an attachment and release mechanism holding the interface device in an attached relationship with the connector.
Figure 4B:
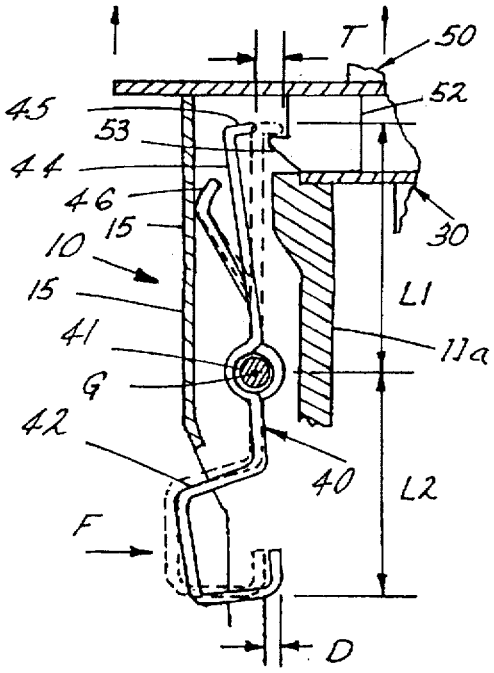
FIG. 4B is a partial cross-section view of the electrical connector showing an attachment clip of the attachment and release mechanism being rotated to release the interface device from the attached relationship with the connector.
Figure 4C:
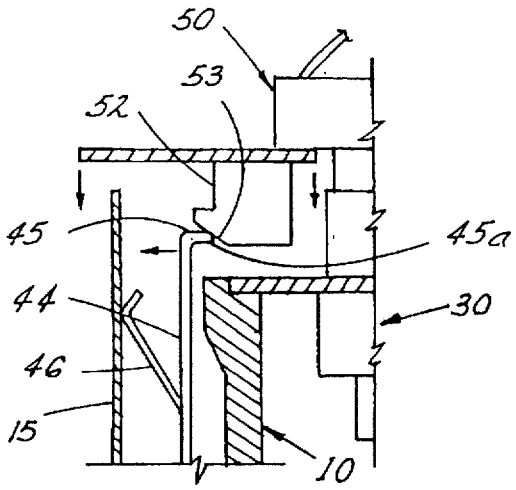
FIG. 4C is a partial cross-sectional view of the electrical connector showing the attachment clip being forced to rotate by a interface attachment of the interface device as the interface device is attached to the insert within the electrical connector.

The interface device 50 includes an interface plate 51, as shown in FIGS. 1, 2, and 4*a–c*, which is substantially rectangular and is sized to extend beyond the extremities of face 14 of backshell 10. Plate 51 carries adjacent opposed ends interface attachments 52 which include an attachment ledge for engagement with attachment clips 40 of securing interface device 50 in an engaged relationship with insert 30. In the attached position, as shown in FIGS. 4*a–c*, plate 51 is engaged with backshell face 14 sealing the face of backshell 10.

An attachment and release mechanism must operate to connect the interface device to the connector backshell in an attached relationship and to release the interface device from the attached relationship by manually displacing a portion of the mechanism. The mechanism illustrated in FIGS. 4A–4D provides the proper functional relationships. In FIG. 4A the attachment clip 40 is positioned within a clip channel 48 formed within an entrance side 10*b* of the connector backshell 10 to the interior of an exterior backshell wall 15. Essentially an identical structure exists within a lateral side 10*d* of the backshell. Further discussion refers to the entrance side illustrated, with the lateral side being essentially the same for the preferred embodiment. However, it may be possible within the scope of this invention to have an attachment clip on only one side of the backshell with the other side having a simple lip and notch attachment.

A pivot pin 41 carried by the backshell positions the attachment clip 40 within the clip channel 48. The clip channel has adequate space for enhanced pivotal movement of the attachment clip within the channel. The exterior backshell wall 15, an interior backshell wall 11*a*, the open backshell face 14 and a clip channel entrance width 48*a* defining the limits of the clip channel entrance. The entrance width is not greater than about 70 percent of a maximum width 48*b* of the clip channel adjacent the pivot axis. The interior backshell wall 11*a* is that part of the connector backshell separating the clip channel 48 from the interior cavity 11 of the backshell. A release arm 42 extends from the channel opening to become exposed to the exterior of the backshell. A curved end portion 15*a* of the exterior wall protects the attachment clip 40 within the clip channel 48 from damage and debris which can limit the use and operation of the attachment and release mechanism. An area of the channel opening 48*a* is made smaller than the cross-sectional area of the clip channel for protecting the attachment clip. The area of the channel opening is preferably not greater than about 70 percent of a cross-sectional area of the clip channel 48 at a location adjacent the pivot axis G.

An attachment stem 44 of the clip extends in one direction from the pivot pin 41 for holding the interface device 50 attached to the electrical insert 30. The attachment clip is in a first pivotal position for making the attachment as illustrated. An attachment flange 45 of the clip makes contact with an interface attachment 52 of the interface device. A clip spring 46 extends from the attachment clip to contact the inside surface of the backshell wall 15 for biasing attachment flange 45 into an engaging position where it overlies an engagement ledge of attachment 52. Attachment 52 is formed with a ramp edge 53 which is designed to engage end 45*a* of flange 45 to bias the engagement end of clip 40 outwardly so that as interface 50 is moved into position, attachment 52 slides along flange 45. Upon ramp edge 53 moving past end 45*a*, spring 46 urges flange 45 into its engaging position with attachment 52. A clip release arm 42 extends in an opposite direction from the pivot pin 41 for releasing the attachment clip from its attached relationship with the interface attachment. An interior portion 42*a* of the release arm 42 is in the same general plane of the attachment stem 44 for providing maximum movement of the attachment clip within the clip channel 48.

The attachment clip has a second pivotal position as illustrated in FIG. 4B. Displacing the release arm 42 manually pivots the attachment clip 40 from the position shown as dashed lines so that a second pivotal position is obtained; as shown by the solid lines with the clip spring 46 deflected. The attachment flange 45 has been released from the latch edge 53 of the interface attachment 52 so that the interface device 50 can be disconnected along a direction illustrated by the direction of the arrows. An arm displacement D produces a flange throw displacement T for releasing the interface device. A mechanical advantage is achieved by respective lengths of the attachment clip. The mechanical advantage is expressed by the ratio of the attachment stem length L1 to the release arm length L2, or L1/L2. A preferred ratio of 1.1 is selected for the attachment clips of this invention.

Figure 4D:
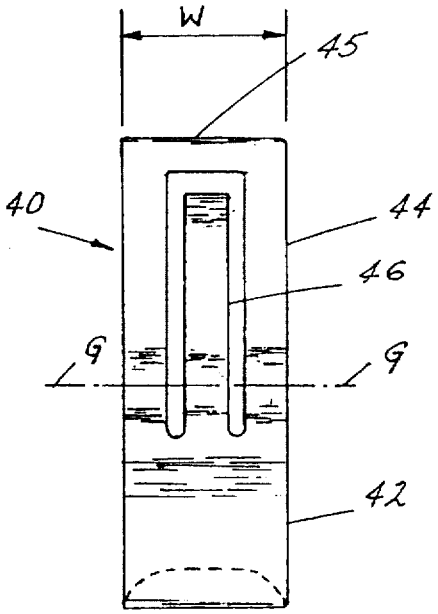
FIG. 4D is an elevation view of a preferred one piece attachment clip of the electrical connector of this invention.

The illustration of FIG. 4D shows an elevation view of a typical attachment clip 40. The attachment flange 45 extends the full width W of the attachment clip 40 to provide an enhanced holding force between the insert and the interface device. The attachment clip is made as a single unit formed to include the release arm 42, the attachment stem 44 and the clip spring 46. The pivot pin extends through the attachment clip along the pivot axis G—G for holding the clip within the clip channel 48 (FIG. 4A). The clip can be made of a material selected from the group consisting of stainless steel, phosphor bronze, beryllium nickel or beryllium copper. Beryllium copper is the preferred material having a superior magnetic permeability. The attachment clips are each stamped from a single piece and made of a beryllium copper alloy 25 material as defined by the American Society of Testing Materials Specification No. B194. The clips are heat treated at 600 degrees Farenheight for three hours before receiving an electroless nickel finish.

Figure 5:
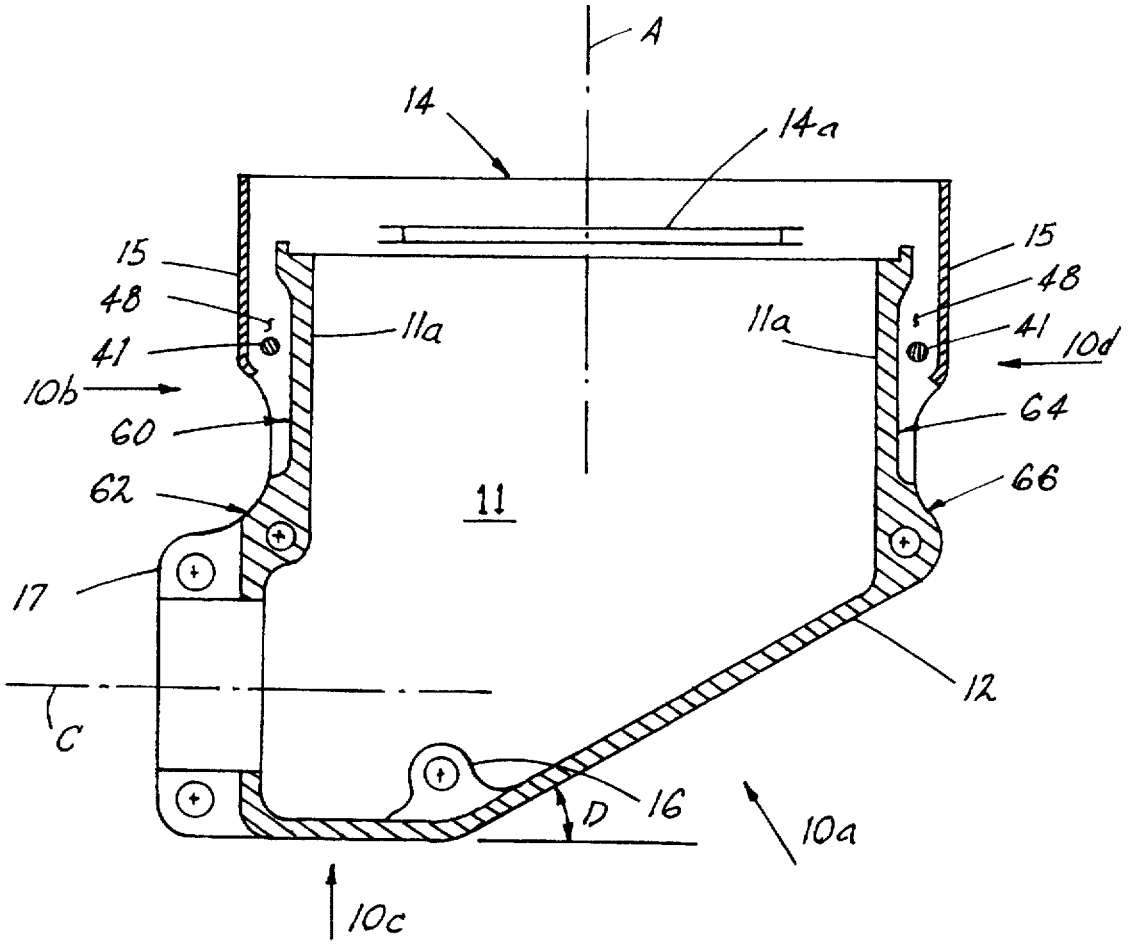
FIG. 5 is a plan view of a cross-section of the first shell portion of the connector backshell of this invention showing clip channels and side configurations.

The configuration of the connector backshell is critical for saving space and weight of the electrical connector. The attachment clips must have adequate space within which to operate and the internal cavity 11 must provide for routing of wires entering the neck 17 along cable axis C. A plan view showing a cross-section of the preferred first shell portion 12 is illustrated in FIG. 5. The preferred second shell portion has a plan view similar to the first shell portion except for the entrance neck and the grounding terminal. First and second shell portions connect to form the complete backshell. A connector retention rib 14*a* is provided in each shell portion to help retain the electrical insert 30. The truncated side 10*a* is opposite the open backshell face 14 which is perpendicular to the interface axis A. The truncation of truncated side is made possible by the configuration of the two lateral sides of the backshell, being the entrance side 10b and the lateral side 10d, and the short neck side 10c. The clip channels 48 are formed in both lateral sides by the exterior backshell walls 15 and the interior backshell walls 11a to accommodate attachment clips; as described above and shown in FIG. 4A. A pivot pin 41 passes through each attachment clip and pivotally attaches the clips to the backshell. The grounding terminal 16 is optimally located at the intersection of the short neck side 10c and the truncated side 10a.

The entrance side 10b of the backshell includes a first recess 60 to provide space for allowing a first release arm to be depressed and a first curvilinear portion 62 transcends into the entrance neck 17. The lateral side 10d of the backshell includes a second recess 64 to provide space for a second release arm to also be depressed and a second curvilinear portion transcends into the truncated side within a relatively short distance. Truncating the connector backshell by forming the truncated side 10a saves space and weight of the electrical connector.

While a preferred embodiment of the invention has been described using specific terms, such description is for illustrative purposes only, and it is to be understood that changes and variations may be made without departing from the spirit or scope of the following claims.

What is claimed is:

1. An electrical connector for connecting wires of a high speed transmission cable with an associated electrical interface device along parallel axis, the connector comprising:

an electrical cable comprising a plurality of wires;

a backshell comprised of a first conductive shell and a second conductive shell forming an interior cavity accessible for receiving said wires and said electrical insert within said interior cavity;

an open backshell face for mounting said electrical insert in position to provide a mating interface between said interface device and said insert;

said first and second shells form an entrance side which extends generally perpendicular to said open backshell face, said entrance side having an entrance opening and an entrance neck which extends generally parallel with said backshell face outwardly from at least one of said first and second shells, said entrance opening being adapted to receive said cable over said entrance neck to route said wires of said cable to said interior cavity along a cable axis at an angle to said interface axis;

a retaining clamp mounted over said entrance neck for securing said cable to said neck such that said retaining clamp can be removed while said shells are secured together;

a grounding terminal carried within said interior cavity of said backshell adjacent said entrance opening for grounding selected of said wires to said backshell; and an attachment mechanism including a pair of manually controlled clips for selectively engaging with and releasing from said associated interface device of said electrical insert.

2. The electrical connector of claim 1 wherein said backshell includes a lateral side arranged opposite and extending parallel of said entrance side, a short neck side extending parallel with said entrance side and a truncated side interfacing with ends of said lateral side and said neck side, said truncated side extending at an angle of between 20 and 40 degrees to the axis of said lateral and neck sides.

3. The connector assembly of claim 1 wherein said connector mechanism further includes;

a clip channel formed within said backshell adjacent said entrance side and an opposed lateral side for receiving said clips;

a pivot pin arranged within each channel forming a pivot axis for said attachment clips;

each said attachment clip including an attachment stem arranged above said pivot and within a respective of said channels, said clip having an attachment flange for engaging an interface attachment of said interface device for holding said interface device in an attached relationship with said electrical insert;

a clip spring engaging with an interior surface of said channel adjacent said attachment stem for biasing said attachment flange into said engaging position with said interface attachment; and, a clip release arm arranged below said pivot and parallel with said attachment stem for manually pivoting said attachment stem about said pivot axis to disengage said attachment flange from said interface attachment prior to disconnecting said interface device from said electrical connector.

4. The connector assembly of claim 3 wherein each said channel includes an entrance opening of a width not greater than about 70 percent of a maximum width of said channel at a location adjacent said pivot axis.

5. The connector assembly of claim 3 wherein said clip channels each include an exterior backshell wall having and end portion forming a part of said open backshell face and said interface device includes a mounting plate, said mounting plate engaging with said backshell face sealing upper ends of said channels when said interface device is engaged with said insert.

6. The connector assembly of claim 1 wherein said angle between said interface axis and said cable axis is approximately 90 degrees.

7. The connector assembly of claim 1 wherein said connector backshell is made of a 6061-T6 aluminum alloy material with an electroless nickel finish.

8. The connector assembly of claim 1 wherein said attachment clips comprise a single piece of a beryllium copper alloy 25 material, as defined by the American Society of Testing Materials Specification No. B194, which is heat treated at 600° F. for three hours before receiving an electroless nickel finish.

* * * * *